United States Patent [19]

Bingham

[11] 4,132,288

[45] Jan. 2, 1979

[54] LADDER WITH RETRACTABLE RUNGS

[76] Inventor: William H. Bingham, 3508 W. Boyce Ave., Fort Worth, Tex. 76133

[21] Appl. No.: 875,310

[22] Filed: Feb. 6, 1978

[51] Int. Cl.[2] ..... E06C 1/387

[52] U.S. Cl. ..... 182/156; 182/100; 182/91; 182/189

[58] Field of Search ..... 182/156, 159, 91, 100, 182/189, 194

[56] References Cited

U.S. PATENT DOCUMENTS

| | | | |
|---|---|---|---|
| 438,036 | 10/1890 | Verstraete | 182/156 |
| 646,291 | 3/1900 | Krueger | 182/156 |
| 928,478 | 7/1909 | Smalley | 182/156 |
| 1,313,444 | 8/1919 | Witherow | 182/156 |
| 1,831,332 | 11/1931 | Wagner | 182/156 |
| 2,148,099 | 2/1939 | Bray | 182/156 |
| 2,553,438 | 5/1951 | Caduff | 182/156 |

*Primary Examiner*—Reinaldo P. Machado
*Attorney, Agent, or Firm*—Wofford, Felsman, Fails & Zobal

[57] ABSTRACT

A ladder with retractable rungs is disclosed herein. The ladder includes an elongated housing having alternating apertures on opposite sides. A stem is carried in the housing. The stem can be manually reciprocated longitudinally and has a series of rungs hingedly attached to it. The rungs engage the apertures and extend outward to provide a step when the stem is moved upward. A supporting rod is pivotally connected inside the housing at its base so as to be swingable from a position to one side of the housing to a center position. The stem must be lifted when the supporting rod is moved to the center position, where the supporting rod then supports the stem with the rungs in the open position. A retaining rod is mounted pivotally inside the housing at the top of the stem. It is also swingable from one side to a center position where it prevents the stem from moving upward. The supporting and retaining rods are connected together by a control rod, and spaced apart vertically so that when one is in an engagement, the other is disengaged.

8 Claims, 8 Drawing Figures

LADDER WITH RETRACTABLE RUNGS

BACKGROUND OF THE INVENTION

1. Field of the Invention

This invention relates in general to ladders and in particular to a pole having retractable rungs.

2. Description of the Prior Art

Burglaries and vandalism are constant and costly occurrences to elevated property. One type of property of this nature is ground navigational equipment for aircraft. The navigational equipment is often mounted on towers or poles in remote areas where security systems can not provide ample protection. Even though a particular installation may be fenced, fences can be scaled and fixed ladders are frequently attached to the towers.

Also, technicians from time to time have to spend several hours at the top of the tower testing equipment. If unfenced or in a neighborhood where children are present, there is a danger that a child may climb the ladder even though the technician is at the top.

In other areas, such as defense and atomic energy plants, different security areas may be present on different vertical levels. Access from one vertical level to the other level may need to be secure. A ladder with retractable rungs would be beneficial, particularly one in which the rungs may be retracted both from the top and from the bottom. Also, the retraction mechanism should be capable of being locked, and the lock should be located so that it cannot be broken off or easily cut.

Ladders with hollow housings and retractable rungs are shown in U.S. Pat. Nos. 928,478 and 1,313,444. The device in the first patent utilizes a rack and pinion mechanism at the base for operating and closing the rungs. The device in the latter patent utilizes a lever arrangement at the base. Neither can be manipulated from the top, and both are more complex than desirable. Neither disclose locking mechanisms other than the access door, which unless of a very heavy construction, can be broken open without much effort.

SUMMARY OF THE INVENTION

It is accordingly a general object of this invention to provide an improved ladder with retractable rungs.

It is a further object of this invention to provide an improved ladder with retractable rungs that can be actuated from either the top or the bottom.

It is a further object of this invention to provide an improved ladder with retractable rungs that can be locked in a manner that renders breaking of the lock extremely difficult.

In accordance with these objects, an improved ladder is provided that utilizes a hollow housing. A stem is mounted in the center of the housing and is capable of being moved vertically a certain distance by hand. The stem has rungs pivotally mounted to it. The rungs extend through holes in the housing wall, and retract depending on the vertical movement of the stem. A supporting rod is located inside the housing at the bottom. It is pivotal in a transverse plane from the side of the housing to the center where it is adapted to support the stem in the open position. A retainer rod is located above the stem and is connected with the supporting rod by a control rod. The retainer rod is pivotal from the side to the center where it restrains the stem from upward movement. When the retainer rod is engaged, the supporting rod is disengaged and vice versa. The control rod and an access door at the top of the stem allow the rungs to be retracted and opened from either the top or the bottom. A locking mechanism from inside the housing allows the supporting member to be padlocked in position, preventing movement even if the access door is broken open.

DESCRIPTION OF THE PREFERRED EMBODIMENT

Figure 1:
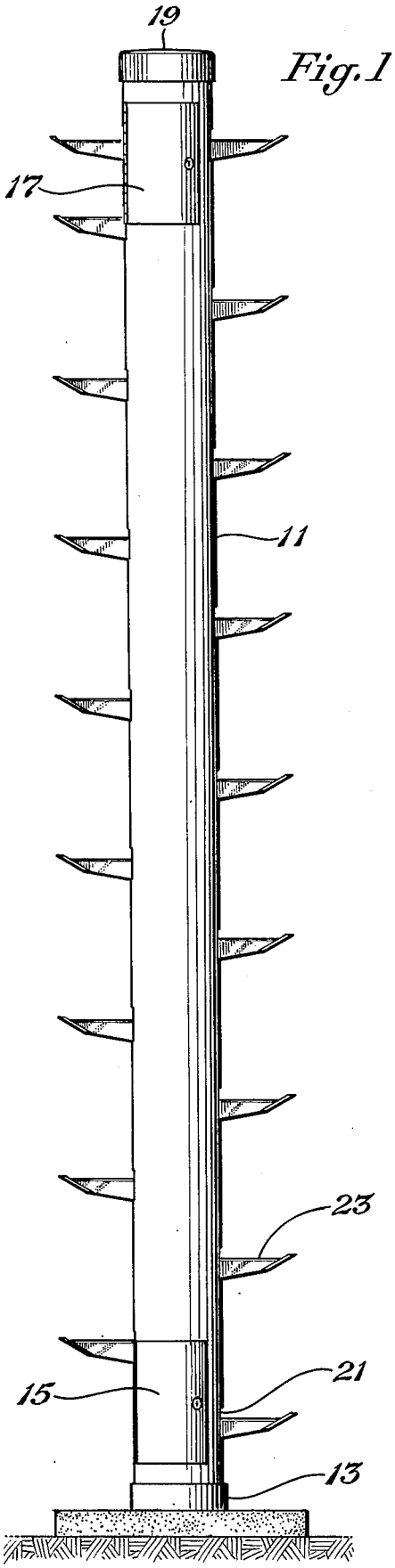
FIG. 1 is a front elevational view of a ladder having retractable rungs in accordance with this invention.

Referring to FIG. 1, a cylindrical pole or housing 11 is shown including a base 13 supported by the earth. Housing 11 either forms the first portion of a taller pole, or serves to support equipment directly at its top, such as navigation instruments (not shown). Housing 11 is hollow with hinged access doors 15 and 17 at the base 13 and top 19 respectively. Housing 11 has a plurality of apertures 21 spaced at regular intervals on opposite sides from each other. Each aperture 21 on one side is centered between two apertures 21 on the opposite side for providing spacing for steps. An extensible rung 23 protrudes through each aperture 21.

Figure 6:
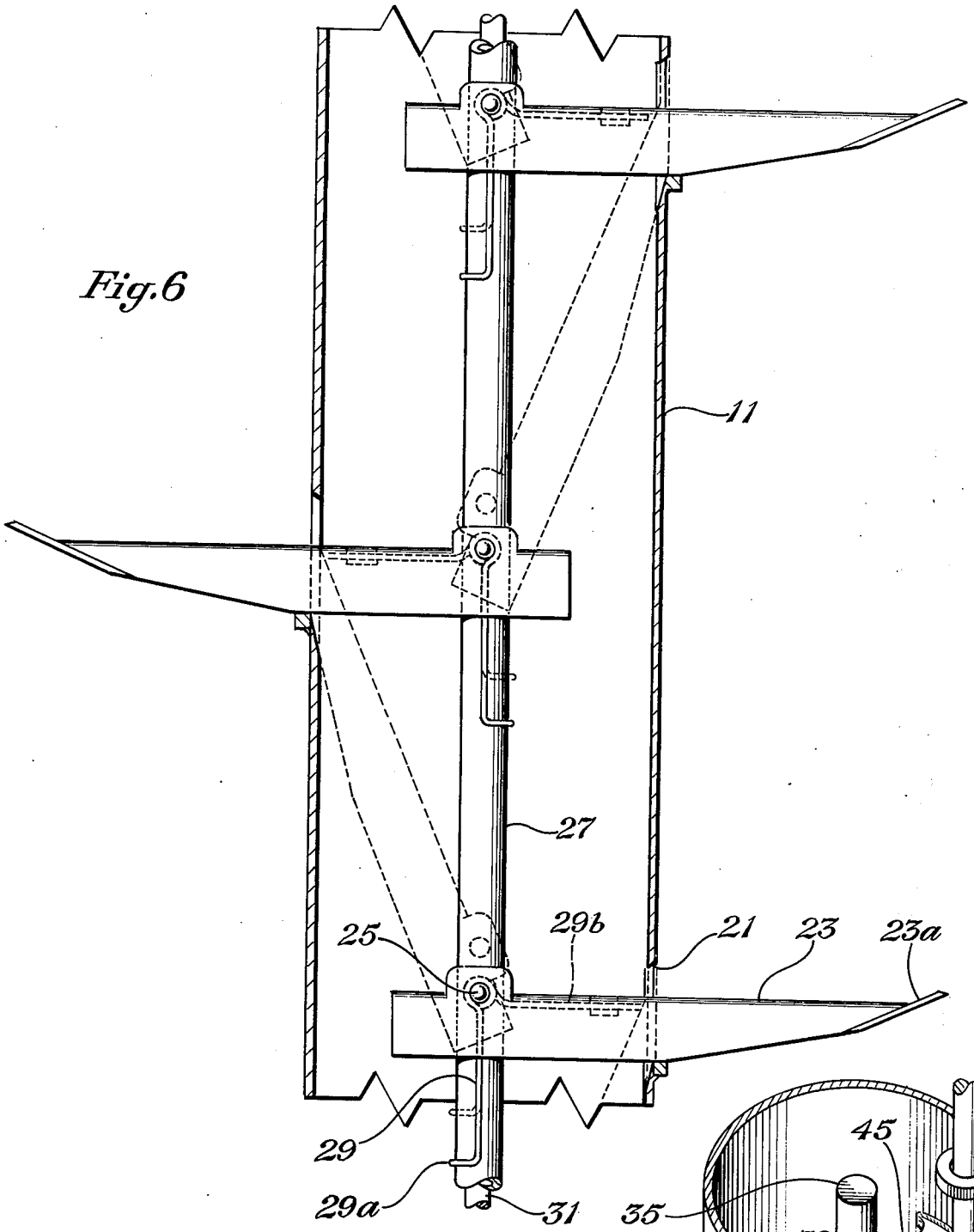
FIG. 6 is a partial, vertical cross-sectional view of the ladder of FIG. 1.

Referring to FIG. 6, the rungs 23 are pivotally mounted by a pin 25 to a central stem 27 carried concentrically in housing 11. Each rung 23 has a slot (not shown) for receiving stem 27. Pin 25 allows the rung 23 to pivot in a longitudinal plane from the open horizontal position to the retracted position, shown in the dotted lines. A spring 29 has one leg **29*a* clipped against stem 27 and the other leg 29*b* bearing against the lower side of rung 23. Spring 29 biases or urges rung 23 toward the horizontal position. Each rung 23 has an inclined outer end 23*a*. The angle of inclination provides a flush fit with the housing apertures 21, which are bevelled to receive the outer end. Vertical or longitudinal movement of stem 27** pivots the rungs between the open and retracted positions.

Figure 2:
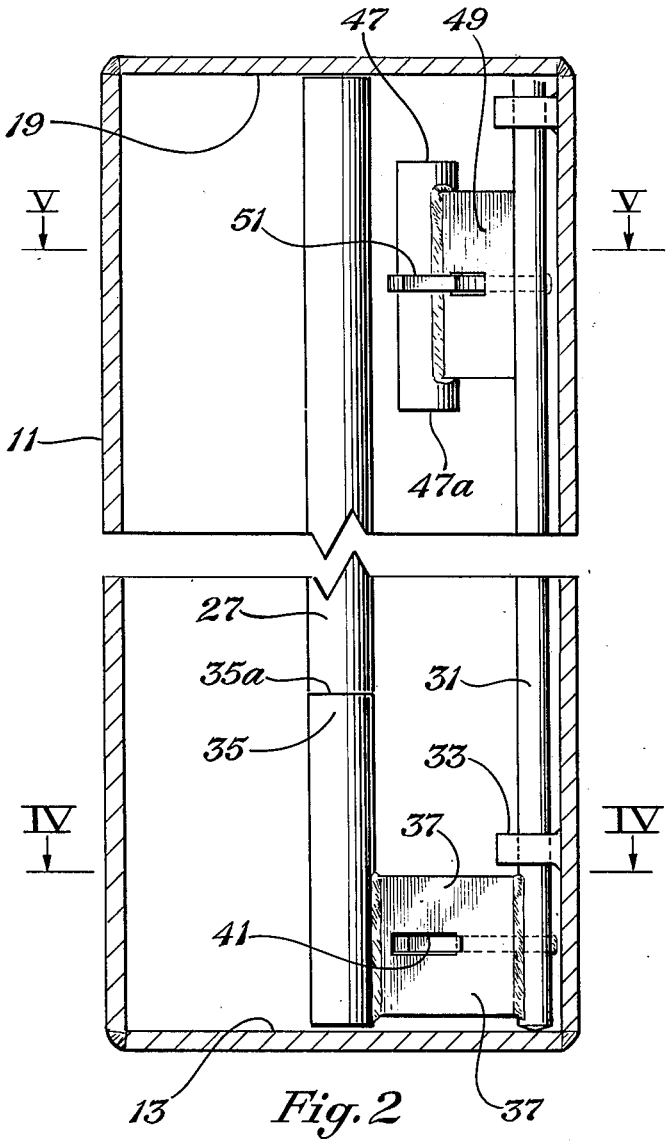
FIG. 2 is a partial vertical cross-sectional view of the ladder of FIG. 1 with the mechanism shown in the open position.

Referring to FIG. 2, a control rod 31 is rotatably mounted in bearings 33 to the inside of housing 11. Control rod 31 is substantially the length of and parallel to stem 27. A supporting member 35 is fixedly mounted to control rod 31 near its bottom by a vertically oriented plate or web 37. Supporting member 35 is a cylindrical solid rod of diameter approximately equal to the diameter of stem 27. Its upper end **35*a* is a load bearing surface adapted to receive the lower end of stem 27. The length of supporting member 35 is selected so as to place the rungs 23 in open position while supporting stem 27. As indicated by the dotted lines in FIG. 4**, supporting member 35 is pivotal or swingable in a transverse plane from the side of housing 11 to its center.

Figure 4:
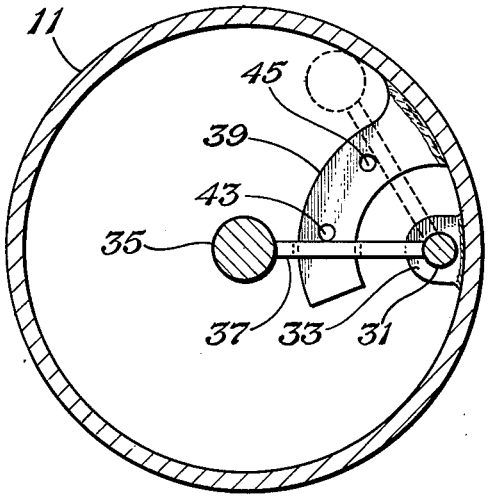
FIG. 4 is a cross-sectional view of the ladder of FIG. 1 taken along the line IV—IV of FIG. 2.
Figure 7:
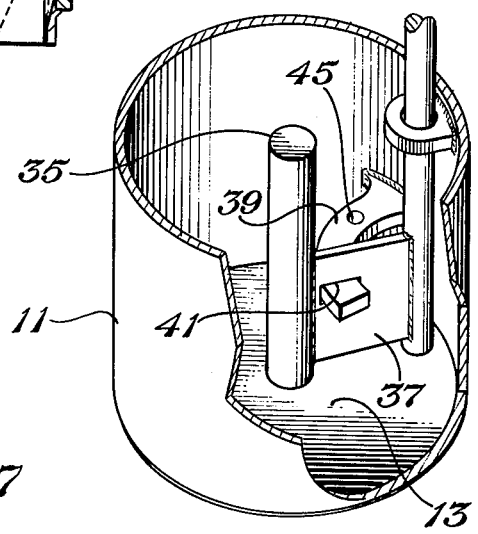
FIG. 7 is a partial, perspective view, partially broken away, of the base of the pole of FIG. 1.

Referring to FIGS. 4 and 7, a curved tongue 39 is welded to the inside of housing 11 and slidably extends through a rectangular slot 41 in web 37. Tongue 39 has two apertures 43, 45 for receiving a padlock to prevent movement of supporting member 35. Door 15 provides access to the supporting member 35 and tongue 39.

Figure 3:
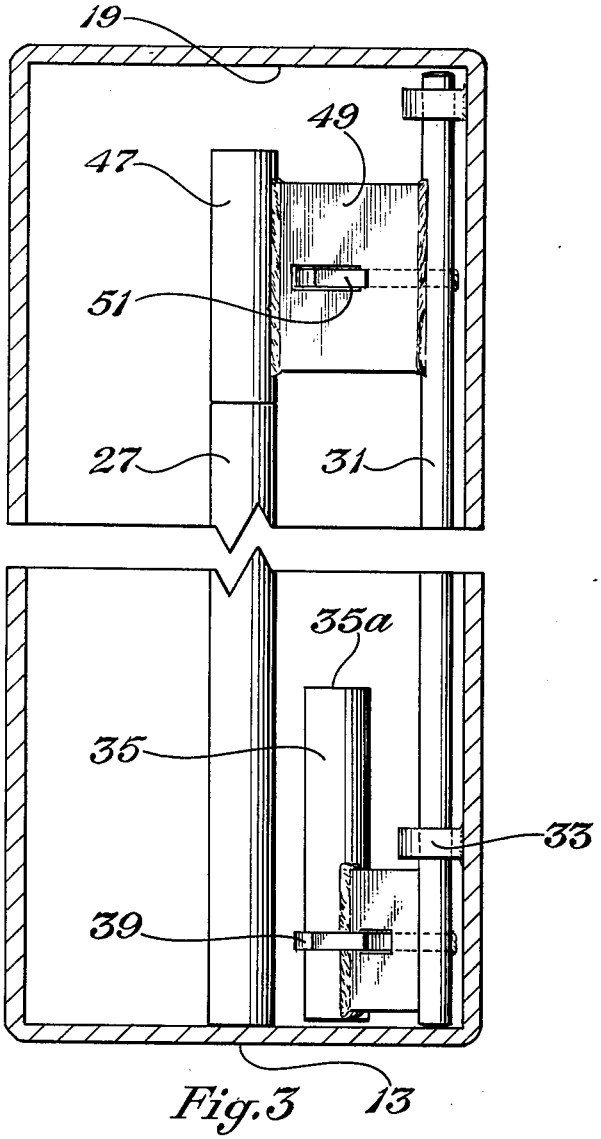
FIG. 3 is a partial cross-sectional view of the ladder of FIG. 1 with the mechanism shown in the retracted position.
Figure 5:
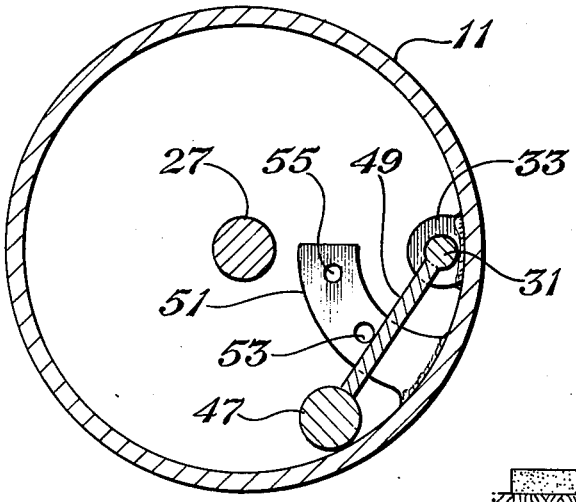
FIG. 5 is a cross-sectional view of the ladder of FIG. 1 taken along the line V—V of FIG. 2.

Referring to FIGS. 2 and 5, a retaining member 47 is fixed to the upper end of control rod 31 by a vertical web 49. Retaining member 47, similar to supporting member 35, is a cylindrical solid rod of diameter approximately equal to the diameter of stem 27. The lower end 47*a* of retaining member 47 is adapted to contact the top of stem 27 to prevent upward movement, as shown in FIG. 3. Retaining member 47 is swingable or pivotal in a transverse plane from the side of the housing to a center position, as shown by the dotted lines of FIG. 5. Supporting member 35 and retaining member 47 are positioned so that when one is engagement, the other is out of engagement. The vertical planes of webs 37 and 49 intersect each other at approximately 60°. Control rod 31 allows the supporting member 35 and retaining member 37 to be pivoted simultaneously from either the top 19 or base 13. A tongue 51, with padlock apertures 53, 55 is also mounted near retaining member 47 and extends through a slot in web 49.

In operation, when a technician is not at the site, the rungs will normally be retracted, with their ends 23*a* flush against apertures 21, as shown in the dotted lines of FIG. 6. Supporting member 35 will be off center and stem 27 will be resting on the base, as shown in FIG. 3. Retaining member 47 will be in the central position preventing upward movement. Consequently, even if one breaks the lock to access door 15, it will not be possible to move stem 27 upward unless the retaining member 47 is pivoted. Since the supporting member 35 will be padlocked in place, the retaining member 47 cannot be pivoted, without cutting or breaking the padlock. Due to the limited access, this will be difficult to accomplish.

To climb the pole, the operator unlocks the supporting member 35 and moves it toward the center position. This moves the retaining member 47 away from this center position, allowing longitudinal movement of stem 27. The operator grasps stem 27 and pushes upward until rungs 23 are fully extended. Springs 29 will facilitate lifting. Once fully extended, the operator swings supporting member 35 into the center position and allows stem 27 to rest on it. If desired, the supporting member 29 can be padlocked in the supporting position. If not, the operator may retract the rungs from the top by moving retaining member 47 toward the center. This displaces supporting member 35 from its supporting position, allowing stem 27 to move downward.

Figure 8:
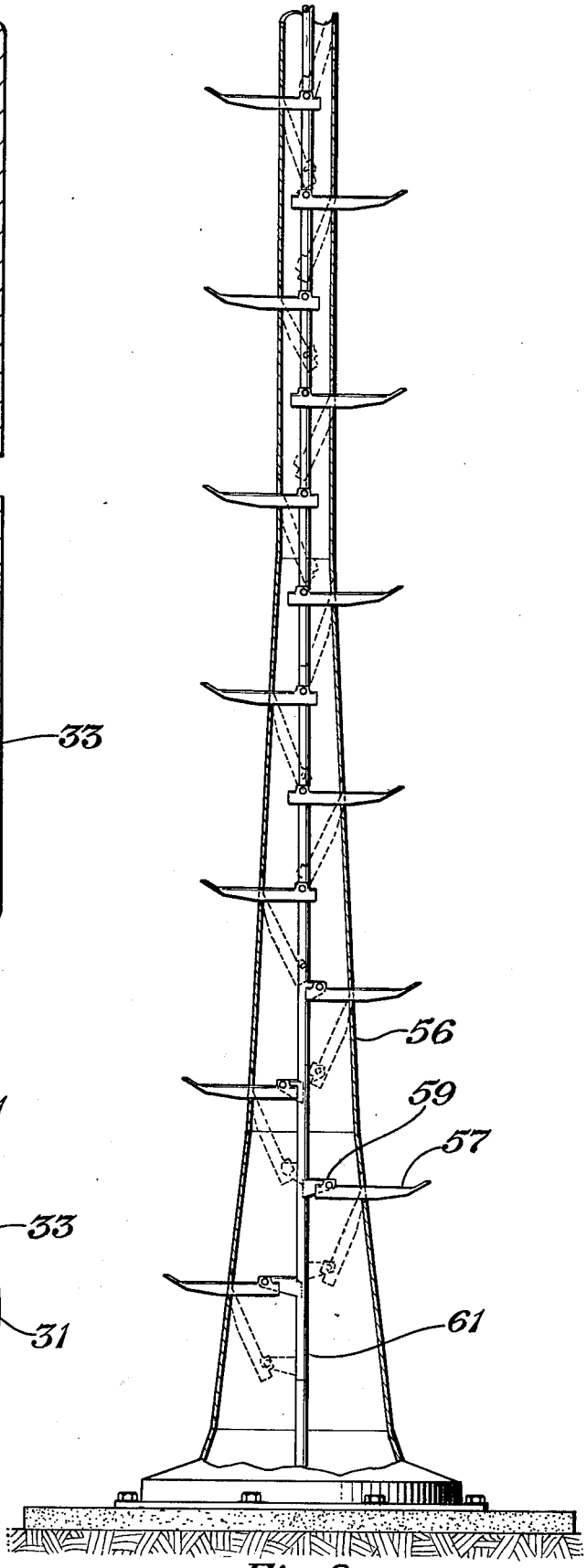
FIG. 8 is a vertical, cross-sectional view of an alternate embodiment of the ladder of FIG. 1.

The length of stem 27 is approximately 20 feet. If a higher pole is necessary, the upper portion will have conventional fixed rungs. Also, one or more conventional rungs will be necessary near access door 17 for retracting the rungs while the operator is at the top of the pole. The housing 11 may be rectangular, or tapered as shown in the housing 56 of FIG. 8. In this embodiment, the rungs 57 are of identical length. In order to compensate for the differing diameter, certain of the rungs in the lower portions are pivotally mounted to transverse arms 59. Transverse arms 59 are fixed to central stem 61 and are of different lengths selected so that the rungs protrude outward approximately the same distance. Rungs 57 are spring biased, and the actuating mechanism operates and is of the same structure as previously described.

It should be apparent that an invention having significant advantages has been provided. The ladder has retractable rungs that can be opened and retracted from either the top or the bottom. The actuating mechanism is simple in construction and readily locked to prevent vandalism.

While this invention has been described in only two of its forms, it should be apparent to those skilled in the art that it is not so limited, but is subject to various changes and modifications without departing from the spirit or scope thereof.

I claim:

1. A ladder with retractable rungs, comprising:
an elongated hollow housing having a series of apertures formed in the side wall;
a stem carried in the housing and longitudinally reciprocal with respect to the housing;
a plurality of rungs pivotally connected to the stem, each extensible through one of the apertures when the stem is moved upward to the open position, and retractable when the stem is lowered to the closed position; and
a supporting member pivotally carried inside the housing, the supporting member having a load bearing surface adapted to support the stem and being pivotal in a transverse plane, for selectively supporting the stem in the open position, and for allowing the stem to move downward to the closed position.

2. The ladder according to claim 1 further comprising a spring connected with each rung for urging each rung into the open position.

3. The ladder according to claim 1 wherein the supporting member is pivotally carried in the housing by a vertical web that has a slot formed through it, and wherein a horizontal tongue is connected to the side wall of the housing and extends through the slot, the tongue having an aperture adapted to receive a padlock to prevent the supporting member from being pivoted into the position for supporting the stem.

4. A ladder with retractable rungs comprising:
an elongated hollow housing having a series of apertures formed in the side wall on opposite sides;
a stem carried centrally in the housing and longitudinally reciprocal with respect to the housing;
a plurality of rungs pivotally connected to the stem, each rung being pivotal in a longitudinal plane with respect to the stem and extensible through one of the apertures from a closed position to an open position;
a spring connected with each rung for urging each rung into the open position;
a control rod mounted rotatably to the inside of the housing;
a supporting member originally connected to the control rod and having a load bearing surface adapted to support the lower end of the stem when placed in the upper position;
a retaining member rigidly connected to the control rod and having a lower retaining surface adapted to contact the upper end of the stem to prevent the stem from moving upward from the closed position when the control rod is in the closed position;
the retaining member being positioned with respect to the supporting member so that pivoting the supporting member into engagement with the lower end of the stem, pivots the retaining member out of engagement with the upper end of the stem.

5. The ladder according to claim 4 wherein the supporting member and the retaining member are rods.

6. The ladder according to claim 4 wherein the supporting member is connected to the control rod by a vertical web that has a slot formed through it; and wherein a horizontal tongue is connected to the side wall of the housing and extends through the slot, the tongue having an aperture adapted to receive a padlock to prevent the supporting member from being pivoted into the position for supporting the stem.

7. The ladder according to claim 4 wherein a portion of the housing tapers upwardly with gradually reducing diameter from the base, and wherein all of the rungs are substantially the same length, with certain of the rungs in the larger diameter areas being mounted pivotally to arms, which in turn are rigidly connected to the stem.

8. The ladder according to claim 4 wherein an access door is located in the housing adjacent the retaining member, providing access to the upper end of the stem and control rod.

* * * * *